United States Patent [19]

Portelli et al.

[11] Patent Number: 4,969,673

[45] Date of Patent: Nov. 13, 1990

[54] DOOR LATCH WITH BLOCK-OUT TYPE CHILD SAFETY FEATURE

[75] Inventors: Alfred L. Portelli, Waterford; Thomas A. Dzurko, Mt. Clemens; Ronald P. Rimbey, Utica, all of Mich.

[73] Assignee: General Motors Corporation, Detroit, Mich.

[21] Appl. No.: 422,320

[22] Filed: Oct. 16, 1989

[51] Int. Cl.[5] ..... E05B 3/00

[52] U.S. Cl. ..... 292/216; 292/DIG. 27; 292/DIG. 65

[58] Field of Search ..... 292/DIG. 27, DIG. 26, 292/DIG. 65, 216, 198, 210, DIG. 38

[56] References Cited

U.S. PATENT DOCUMENTS

| | | | |
|---|---|---|---|
| 3,111,339 | 11/1963 | Nadeau | 292/DIG. 65 X |
| 3,697,105 | 10/1972 | Marx | 292/DIG. 27 X |
| 3,923,329 | 12/1975 | Torii et al. | 292/DIG. 27 X |
| 4,334,704 | 6/1982 | Yamada | 292/216 |
| 4,487,441 | 12/1984 | Miyamoto et al. | 292/216 X |
| 4,492,395 | 1/1985 | Yamada | 292/216 |
| 4,756,563 | 7/1988 | Garwood et al. | 292/216 |

*Primary Examiner*—Eric K. Nicholson

*Attorney, Agent, or Firm*—Herbert Furman

[57] ABSTRACT

This invention relates generally to a child safety vehicle door lock with a blocking arrangement for selectively blocking operation of an operating handle to prevent release of the door latch by an unauthorized person such as a child passenger. The blocking arrangement includes a blocking lever of plastic material pivotally mounted of the latch frame for manual movement between blocking and non-blocking positions. The blocking lever and frame have detent elements for releasably locating the blocking lever in each of its positions. The blocking lever includes a portion, which when in the blocking position, is engaged on one side by the frame and engaged on the other side by the a portion of the operating lever.

3 Claims, 2 Drawing Sheets

DOOR LATCH WITH BLOCK-OUT TYPE CHILD SAFETY FEATURE

DOOR LATCH WITH BLOCK-OUT TYPE CHILD SAFETY FEATURE

This invention relates generally to vehicle door latches and more particularly to a vehicle door latch having a blocking arrangement for selectively blocking operation of an operating means to prevent unauthorized unlatching of the door latch.

It is known to provide vehicle door latches with blocking arrangements for selectively blocking operation of an inside operator or handle to prevent release of the door latch by an unauthorized person, such as a child passenger. It is also known to provide such door latches with uncoupling arrangements which uncouple the inside operator or handle from the door latch to accomplish the same purpose.

The vehicle door latch of this invention is of the former type and provides a blocking lever which cooperates with the latch frame to block operation of a latch operator and prevent release of the door latch by an unauthorized person.

In the preferred embodiment of the invention, the blocking arrangement includes a blocking lever of plastic material which is pivotally mounted on the latch frame for manual movement between blocking and non-blocking positions. The blocking lever and frame include mutually cooperable detent means for releasably locating the blocking lever in each of its positions. The blocking lever includes a blocking portion which engages the latch frame in the blocking position of the blocking lever. The inside release lever of the door latch is also pivotally mounted on the latch frame and operates a detent release means of the door latch to release the detent and permit movement of the latch bolt to unlatched position. The release lever shoulder or edge which is engageable with the blocking portion of the blocking lever generally opposite the engagement of the blocking position with the latch frame to thereby block movement of the inside release lever and release of the detent when the blocking lever is in blocking position. The engagement of the blocking portion of the lever with the latch frame generally opposite the engagement of the blocking portion by the inside release lever reinforces such blocking portion against breakage under the lever multiplied force of the inside release lever. Thus, the blocking lever can be made of plastic material and still be effective.

The primary feature of this invention is that it provides a blocking lever for selectively blocking operation of a latch operator of a vehicle door latch. Another feature is that the blocking lever is of plastic material and includes a blocking portion which is backed up or reinforced by the latch frame when engaged by the latch operator to block operation of the detent release means of the door latch. A further feature is that the blocking lever is manually movable between blocking and non-blocking positions and includes detent means cooperable with detent means of the latch frame to releasably locate the blocking lever in each of its positions. Yet another feature is that the blocking lever includes an integral positioning arm having the detent means cooperable with the detent means of the latch frame to releasably locate the blocking lever in each of its positions, an integral blocking arm cooperable with the latch frame for blocking operation of the inside operator, and an integral operating arm for manual movement of the blocking lever between its positions.

These and other features of the invention will be apparent from the following specification and drawings wherein.

Figure 1:
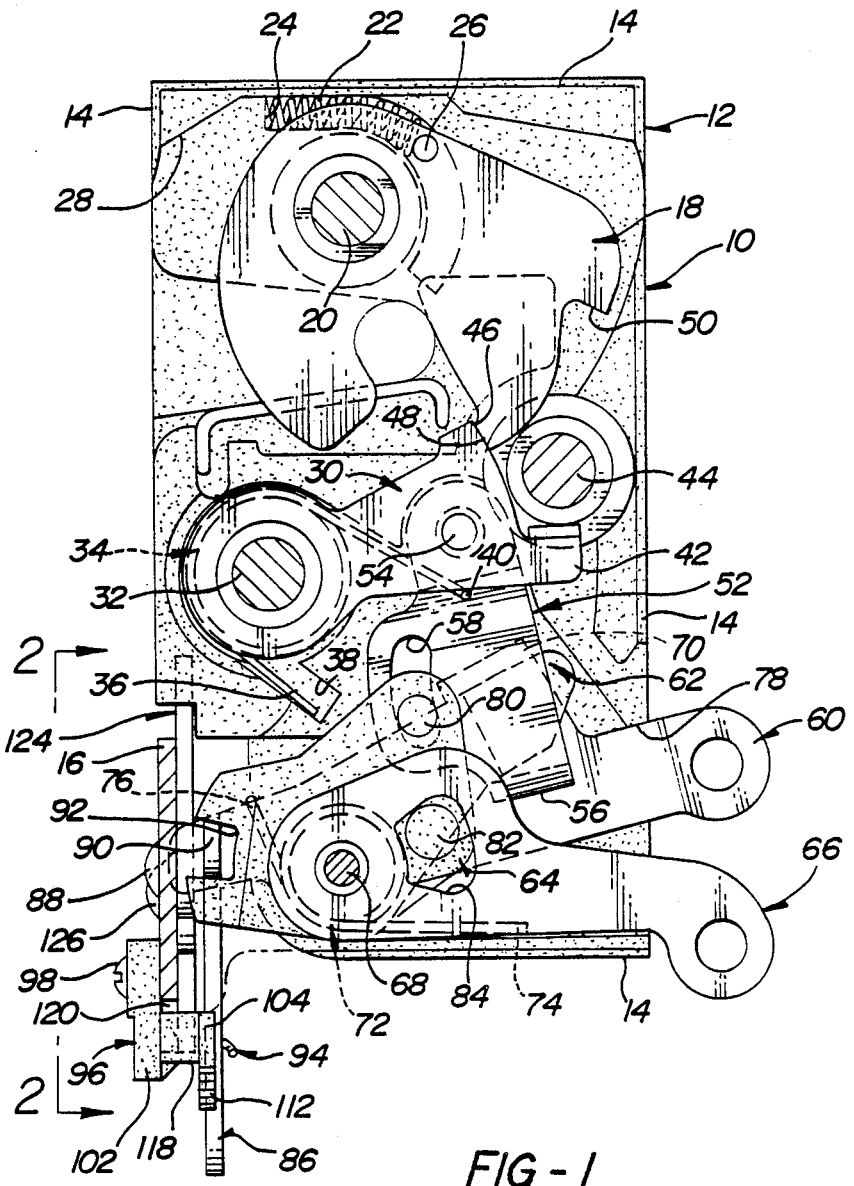
FIG. 1 is a partially broken away view of a vehicle door latch embodying a blocking arrangement according to this invention, with the latch being shown in unlocked condition and the latch bolt being shown in latched position.

Referring now to FIG. 1 of the drawings, the vehicle door latch 10 shown is substantially the same as that shown and described in Garwood et al U.S. Pat. No. 4,756,563 , Vehicle Door Latch, issued July 12, 1988, and assigned to the assignee of this invention. Therefore, only a brief description necessary for an understanding of this invention will be given and reference may be had to the Garwood et al patent for further details of the door latch 10.

The latch 10 includes a molded plastic housing member 12 which opens outwardly and has a series of peripheral wall portions 14 along the outer walls thereof. A cover, not shown, fits within the wall portions 14 and includes a lateral extension or side flange 16, shown in detail in FIGS. 2 through 4.

A fork type bolt 18 is pivoted on a bushing 20 which is mounted within the housing member 12. A coil compression spring 22 in a recess 24 of the housing member engages a pin 26 of the latch bolt to bias the bolt clockwise from its latched position shown, to an unlatched position, not shown, wherein the outer edge of the bolt engages a shoulder 28. of the housing member 2.

The bolt is held in latched position by a detent 30 which is pivoted on another bushing 32 mounted within the housing member 12. The detent is biased counterclockwise by a torsion spring 34 which surrounds the bushing 32 and has one leg 36 anchored in a recess 38 of the housing member and the other leg provided with a lateral terminal 40 which engages the lower edge of the detent. The engagement of a rubber bumpered leg 42 of the detent with another bushing 44 mounted within the housing member 12 locates the detent in detented position under the bias of the spring 34. In detented position, a detent shoulder 46 engages a primary latching shoulder 48 of the bolt 18 to retain the bolt in primary latched position. The detent shoulder 46 is also engageable with a secondary latching shoulder 50 of the latch bolt 18 to retain the bolt in secondary latched position.

An intermittent member 52 is pivoted at 54 to the detent 30 and includes a lower lateral tab 56 and an arcuate slot 58. An outside operating lever 60, a transfer lever 62, a locking lever 64, and a key cylinder lever 66 are all coaxially mounted on a shouldered stud 68 mounted within the housing member 12. A lateral tab 70 of the outside operating lever 60 engages the upper edge of the transfer lever 62 to pivotally couple the levers 60 and 62. A coil torsion spring 72 surrounds the stud 68 and has one leg 74 engaging the lower wall of the housing member 12 and the other leg 76 hooked over the transfer lever 62 to bias the transfer lever 62 and the outside operating lever 60 counterclockwise about the stud 68 and engage the operating lever 60 with a shoulder 78 of the housing member 12. The outside operating lever 60 is conventionally connected to a manually operable outside operator, such as a pull type, paddle type, or push button type handle which rotates the levers 60 and 62 clockwise to operating position. The engagement of the lower edge of the transfer lever 62 with the lateral tab 56 of the intermittent member 52, when the intermittent member is in coupled position, as shown, moves the intermittent member downwardly and in turn rotates the detent 30 clockwise about the bushing 32 against the bias of spring 34 to undetented position, not shown, wherein the detent shoulder 46 is out of engagement with the latch bolt shoulder 48 to permit the latch bolt to move to unlatched position.

The locking lever 64 includes a pin 80 received in the arcuate slot 58 of the intermittent member 52 and a pin 82 received in an opening 84 of the key cylinder lever 66. The key cylinder lever 66 is conventionally connected to an outside key cylinder for clockwise movement of the lever 66 between its unlocked position shown, and an unlocked position, not shown, clockwise of its unlocked position. This movement of lever 66 engages the edge of opening 84 with pin 82 to move the locking lever 64 clockwise from its unlocked position as shown to a locked position wherein the pin 80 rotates the intermittent member 52 slightly counterclockwise to uncoupled position. In uncoupled position, the lateral tab 56 of the intermittent member 52 is located to the right of the transfer lever 62 to uncouple the transfer lever and outside operating lever 60 from the intermittent member 52.

Figure 2:
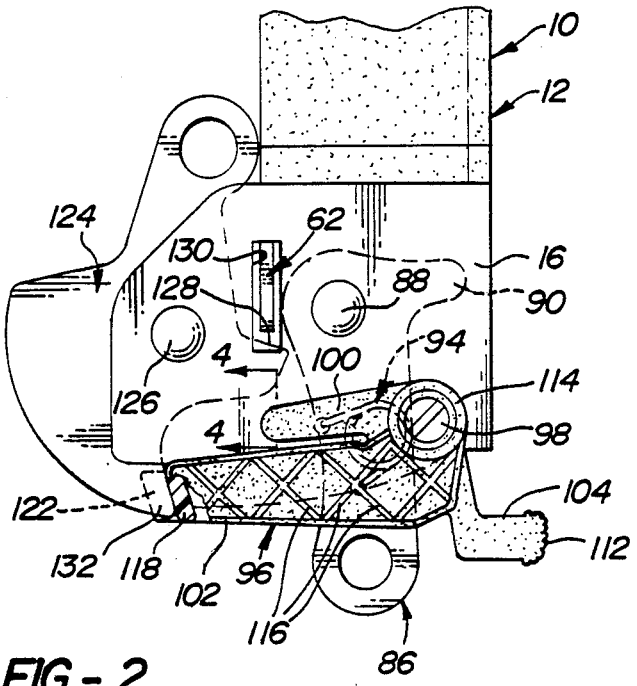
FIG. 2 is a view taken along line 2—2 of FIG. 1 showing the blocking lever in blocking position.
Figure 4:
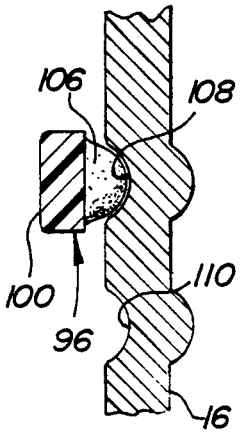
FIG. 4 is a sectional view taken along line 4—4 of FIG. 2.
Figure 3:
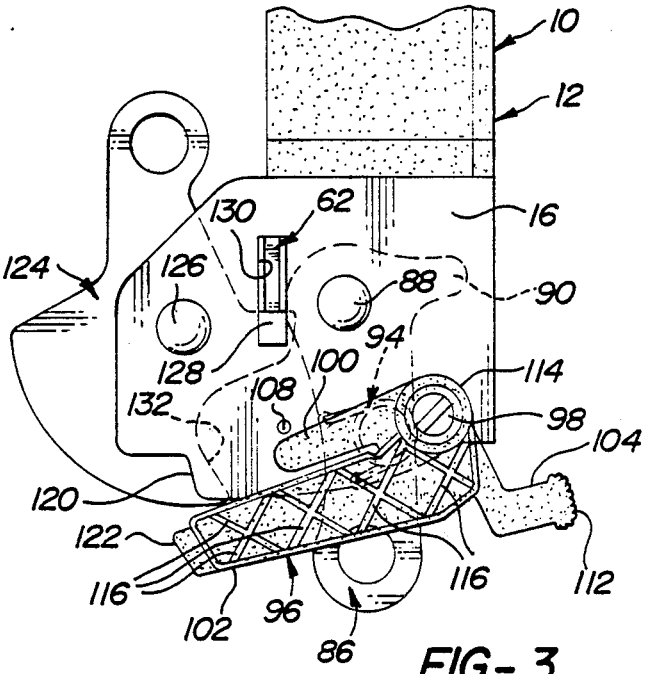
FIG. 3 is a view similar to FIG. 2 showing the blocking lever in non-blocking position.

As shown in FIGS. 2 through 4, an inside locking lever 86 is pivoted at 88 to the inner side of the side flange 16 and includes a leg 90 which is received in a slot 92 of the locking lever 64, FIG. 1. An overcenter spring 94 is coupled between the lever 86 and the flange 16 to alternately locate the lever 86 in its unlocked position shown, or its locked position, not shown, counterclockwise of its unlocked position, wherein the lever 86 locates the locking lever 64 in its locked position, previously described. The inside locking lever 86 is conventionally coupled to an inside garnish button, lever, or other inside lock operator.

In accordance with this invention, a blocking lever 96 of plastic material is pivoted by pin 98 to the outer side of the flange 16 and includes a positioning arm 100, a blocking arm 102, and an operating arm 104. As shown in FIG. 4, the positioning arm 100 includes an integral button or nub 106 which is alternately received in either of two like integral depressions 108 and 110 of flange 16 to locate the blocking lever in either a blocking position, shown in FIG. 2, or a non-blocking position shown in FIG. 3. The operating arm 104 terminates in a ridged end 12 which projects outwardly through a slot in the lock pillar wall, not shown of the vehicle door on which the latch 10 is mounted so as to be manually engaged for movement of the blocking lever between its blocking and non-blocking positions. The lock pillar wall of the door is inaccessible when the door is closed. Therefore, the blocking lever can only be located in the desired position when the door is in an open position.

The blocking arm 102 is of generally U-shaped cross section to obtain light weight. The side walls and right hand end wall of the blocking arm merge into a thicker apertured circular portion 114 which receives pin 98. The walls of the blocking arm are interconnected by a series of cross ribs 116 for strength purposes. The blocking arm 102 includes a blocking portion 118, FIGS. 1 and 2, which extends laterally thereto and has one side thereof engaging an edge or shoulder 120 of the flange 16 when the blocking lever 96 is in blocking position shown in FIG. 2. A terminal flange 122 extends laterally from the blocking portion 118.

An inside operating lever 124 is pivoted at 126 to the inner side of the flange 16 and is conventionally connected to an inside handle or other operator to locate the lever 124 in its position shown in FIG. 2. The lever 124 includes a foot 128 which underlies the left hand end, FIG. 1, of the transfer lever 62. This end moves within a slot 130 of flange 16. When pivoted counterclockwise as viewed in FIGS. 2 and 3, the foot 128 engages and rotates the transfer lever 62 clockwise as viewed in FIG. 1. If the intermittent member 52 is in coupled position, the engagement of the lower edge of the transfer lever with the lateral tab 56 of the intermittent member 52 releases the detent as previously described.

The inside operating lever 124 includes an additional foot 132. Should the blocking lever 96 be in blocking position as shown in FIG. 2 and the inside operating lever 124 be rotated counterclockwise by the inside operator, the edge of the foot 132 will engage the other side of the blocking portion 118 to block any engagement of the foot 128 with the transfer lever 62 and prevent release of the detent. The flange 122 acts as a guide for the lever 124 and prevents movement of the lever 124 laterally of the blocking portion 118 under excessive force applied to the lever 124 by the inside operator.

It will be noted that the foot 132 engages the other side of the blocking portion 118 generally opposite the engagement of the one side of the blocking portion with the shoulder 120 of the flange 16. Thus, the flange 16 backs up or reinforces the blocking portion 118 against breakage should excessive force be applied to the lever 124 by the inside operator. This arrangement of the blocking portion with respect to the flange 16 and inside operating lever 124 permits the blocking lever 96 to be formed of plastic material for light weight, and yet be able to withstand any excessive force applied thereto by the inside operating lever.

Thus, this invention provides a vehicle door latch having an improved blocking arrangement for selectively preventing release of the door latch by an unauthorized person.

The embodiments of the invention which an exclusive property or privilege is claimed are defined as follows:

1. In a vehicle door latch having frame means, latch bolt means mounted on the frame means for movement between latched and unlatched positions, detent means mounted on the frame means for movement between a detented position wherein the detent means retains the latch bolt means in latched position, and an undetented position wherein the detent means permits the latch bolt means to move to unlatched position, detent release means for moving the detent means to undetented position, and operating means movable along a path of movement from an idle position to an operating position for operating the detent release means, a blocking arrangement for selectively blocking movement of the operating means to operating position, comprising, in combination, a blocking lever mounted on the frame means for movement between blocking and non-blocking positions with respect to the operating means, the blocking lever including a positioning arm, a blocking arm, and an operating arm, cooperating means on the positioning arm and the latch frame for releasably detenting the blocking lever in either a blocking or a non-blocking position, blocking means on the blocking arm positioned in engagement with the frame means and in the path of movement of the operating means in the blocking position of the blocking lever, the operating means engaging the blocking means in the blocking position of the blocking lever to prevent movement of the operating means to operating position, the frame means backing up the blocking means when engaged by the operating means, the operating arm including manually accessible means for selectively moving the blocking lever between blocking and non-blocking positions.

2. In a vehicle door latch having frame means, latch bolt means mounted on the frame means for movement between latched and unlatched positions, detent means mounted on the frame means for movement between a detented position wherein the detent means retains the latch bolt means in latched position and an undetented position wherein the detent means permits movement of the latch bolt means to unlatched position, detent release means for moving the detent means to undetented position, and operating means movable along a path of movement from an idle position to an operating position for operating the detent release means, a blocking means for selectively blocking movement of the operating means to operating position comprising, in combination, a blocking lever of light weight material mounted on the latch frame for movement between blocking and non-blocking positions with respect to the operating means, cooperating means on the blocking lever and the frame means for releasably detenting the blocking lever in either a blocking or a non-blocking position, blocking means on the blocking lever positioned in engagement with the frame means and in the path of movement of the operating means in the blocking position of the blocking lever to prevent movement of the operating means to operating position, the blocking means being engaged by the operating means generally opposite the engagement of the blocking means with the frame means whereby the frame means backs up the blocking means and prevents breakage thereof when engaged by the operating means, and manually operable means for moving the blocking lever between blocking and non-blocking positions.

3. In a vehicle door latch having frame means, latch bolt means mounted on the frame means for movement between latched and unlatched positions, detent means mounted on the frame means for movement between a detented position wherein the detent means retains the latch bolt means in latched position and an undetented position wherein the detent means permits movement of the latch bolt means to unlatched position, detent release means for moving the detent means to undetented position, and operating means movable along a path of movement from an idle position to an operating position for operating the detent release means, a blocking means for selectively blocking movement of the operating means to operating position comprising, in combination, a blocking lever mounted on a planar portion of the frame means for movement in a path generally parallel to said frame means between blocking and non-blocking positions with respect to the path of movement of the operating means, cooperating means on the blocking lever and the frame means for releasably detenting the blocking lever in either a blocking or a non-blocking position, the blocking lever including a blocking portion extending laterally to the planar portion of the frame means and engaged with said frame means in the blocking position of the blocking lever, the operating means engaging the blocking portion of the blocking lever generally opposite the engagement of the blocking portion with the frame means whereby the frame means backs up the blocking portion and prevents breakage thereof when engaged by the operating means to. prevent movement of the operating means from idle position to operating position, and means for moving the blocking lever.

* * * * *